US005732724A

United States Patent [19]

Becknell

[11] Patent Number: 5,732,724

[45] Date of Patent: Mar. 31, 1998

[54] SINK MOUNTED WATER AGITATION

[75] Inventor: Dwayne A. Becknell, Nashville, Tenn.

[73] Assignee: Ecolab Inc., St. Paul, Minn.

[21] Appl. No.: 648,214

[22] Filed: May 15, 1996

[51] Int. Cl.[6] ..... B08B 3/04

[52] U.S. Cl. ..... 134/107; 134/108; 134/186; 134/191; 134/195

[58] Field of Search ..... 4/541.3, 541.6; 134/107, 108, 115 G, 186, 191, 195; 68/184; 366/136, 137, 165.1, 165.2, 175.2

[56] References Cited

U.S. PATENT DOCUMENTS

| | | | |
|---|---|---|---|
| 1,580,476 | 4/1926 | Fassio | 366/137 X |
| 1,668,923 | 5/1928 | Rymann | 134/191 |
| 1,836,063 | 12/1931 | Bloom | 68/184 X |
| 1,995,405 | 3/1935 | Thorley | 68/184 |
| 2,076,688 | 4/1937 | West | 141/9 |
| 2,342,559 | 2/1944 | Sebald et al. | 366/137 |
| 2,392,540 | 1/1946 | Lyman | 299/62 |
| 2,418,366 | 4/1947 | Powers | 134/186 X |
| 2,745,417 | 5/1956 | Fielding | 134/58 |
| 2,824,648 | 2/1958 | Bear | 210/238 |
| 2,905,092 | 9/1959 | Abresch | 103/87 |
| 2,943,633 | 7/1960 | Marmo et al. | 134/174 |
| 3,051,183 | 8/1962 | Jacobs | 134/174 |
| 3,085,576 | 4/1963 | Rocke | 4/541.3 X |
| 3,086,538 | 4/1963 | Voltz | 366/137 X |
| 3,210,010 | 10/1965 | Delapena | 239/242 |
| 3,324,867 | 6/1967 | Freese | 134/99 |
| 3,784,116 | 1/1974 | Buckman et al. | 241/46.17 |
| 3,823,879 | 7/1974 | Johnson | 241/101.2 |
| 3,998,938 | 12/1976 | Szegvari | 423/594 |
| 4,036,714 | 7/1977 | Spitzer | 204/99 |
| 4,436,617 | 3/1984 | Moore et al. | 209/3 |
| 4,461,625 | 7/1984 | Smith et al. | 44/10 R |
| 4,719,128 | 1/1988 | Krulik | 427/345 |
| 4,778,532 | 10/1988 | McConnell et al. | 134/10 |
| 4,781,206 | 11/1988 | Noren | 134/174 |

FOREIGN PATENT DOCUMENTS

| | | | |
|---|---|---|---|
| 1072187 | 3/1954 | France | 68/184 |

*Primary Examiner*—Philip R. Coe

*Attorney, Agent, or Firm*—Merchant, Gould, Smith, Edell, Welter & Schmidt P.A.

[57] ABSTRACT

Household and institutional sinks are commonly used in cleaning regimens in which articles are contacted with aqueous cleaning media under conditions of agitation. Such agitation can be provided by directing the aqueous medium contained within the sink to a pump that returns the aqueous medium to the sink under agitating conditions such that the agitation can act to promote soil removal. The aqueous medium can be withdrawn from a waste line installed in a sink drain. The aqueous medium can then pass into a pump which can return the aqueous medium to the sink at a location in the sink causing the aqueous medium to agitate and circulate within the sink bowl. Preferably, valved waste line hardware can be installed in the drain such that when the waste line valve is closed, the aqueous medium is retained in the sink. The pump intake is placed in liquid communication with the aqueous cleaning medium upstream of the valve. The aqueous cleaning medium is drawn by the pump from the waste line and is then directed by the pump returning to an annular return collar formed on the waste line installed in the drain. The pumped aqueous medium is directed by the return collar into the bowl of the sink assembly. The return collar has a stator creating a horizontal cyclonic circulation pattern.

19 Claims, 5 Drawing Sheets

SINK MOUNTED WATER AGITATION

FIELD OF THE INVENTION

The invention relates to household and institutional sinks used in cleaning flatware, kitchenware and dishware. The sink can comprise one two or more bowls in a sink unit. Each bowl can have sufficient capacity to hold a significant quantity of water or aqueous cleaning liquid and flatware, dishware or kitchenware. The sink can also comprise cleaning apparatus or a chemical dispenser.

BACKGROUND OF THE INVENTION

Although kitchen sinks have been used in a variety of environments including household, hotels, restaurants, hospital food service, military food service and other places, sinks commonly have not been used actively as a power driven cleaning station. Most commonly, such sink installations have been used for static soaking or handwashing ware. Such sinks are provided with two, three or more bowls in which kitchen personnel soak kitchenware and dishware in water for the purpose of softening food soils for later hand or automatic machine cleaning. Commonly, pot and pan soak chemicals, dish soap compositions, etc., can be added to the water to aid in typically static soaking of food soils.

One device known as the POWER SOAK® system is known comprising an installation that is distributed as a single unit comprising a three bowl sink assembly having a pumped top to bottom pattern. In the POWER SOAK®, the circulation of water or aqueous cleaner in a liquid contents of the sink is withdrawn from an intake installed in an arbitrary location in the sink or bowl. Water is drawn from the intake through the pump and then is directed through nozzles installed on the upper interior portion of the sink or bowl at or just below the liquid surface forcing the aqueous solution in a top to bottom circulation pattern. The POWER SOAK® apparatus is manufactured as a single unit and cannot easily be disassembled and retrofitted to existing sink units. Further, we have found that the horizontal top to bottom circulation pattern of the POWER SOAK® is not an optimal pattern for soil softening or removal.

Accordingly, a substantial need exists for a device that can act to circulate water within a bowl in an optimal pattern. Further, the apparatus should be easily retrofitted to common sink installations in both household and institutional cleaning environments.

BRIEF DISCUSSION OF THE INVENTION

We have found that the optimal circulation pattern for an agitated cleaning solution in a bowl in a sink involves moving the solution in a horizontal pattern with a swirling or cyclonic motion formed around the center of the sink. Such a horizontal circulation can provide movement of the aqueous cleaning medium contained within the sink against food soils formed on both the interior and the exterior of flatware, kitchenware and tableware contained within the sink medium. Further, the horizontal circulation formed around the bowl can also cause a cyclonic movement of the ware resulting in a tumbling or other complex motion or circulation of the ware in the swirling stream of the aqueous medium. Such an energetic motion provides a superior cleaning environment for kitchenware and tableware.

Such a motion can be produced in both households or institutional sinks adapted to cleaning with an apparatus designed and engineered to form an agitated aqueous cleaning medium. The sink can contain one or more bowls each having a liquid capacity of up to 200 liters of aqueous liquid medium or more. The bowl can have a drain (i.e.) a simple circular aperture for the passage of liquid and any solids, liquids or dissolved solids, formed in a lower portion of the bowl. A waste line can be in liquid communication with the drain which directs liquid contents to municipal sewer disposal. A pump can be installed in liquid communication with the waste line such that the water or aqueous cleaner can be removed from the waste line downstream from the drain and, be returned to the bowl or sink. The pump draws the aqueous medium from the waste line and returns it to the bowl through liquid outlet means installed in the base of the bowl that causes the aqueous medium from the pump to swirl in a horizontal flow with sufficient energy to tumble the dishware and kitchenware or cause the ware to move in a complex motion within the sink.

The aqueous cleaning medium held in the sink can comprise a major proportion of an aqueous medium such as service water derived from the local water utility containing a minor, but important cleaning proportion of a cleaning material selected from the group consisting of a surfactant, a solvent, an acid, a base, a bleach or compatible mixtures thereof. The pump used in forming the horizontal circular motion of the water can be a pump with a power output of about 0.25 to 4 HP or more having a pump output capacity of about 70–1250 liters of water per minute and preferably, can have a power output of between 0.5 and 2 horsepower. The pump can be a centrifugal pump having vanes that can drive the water energetically through the agitation means.

Further, the sink of the invention can have an apparatus cooperatively installed in the drain and adapted to returning the aqueous cleaning medium under pressure to a collar or other aqueous return that can direct the flow of the aqueous medium in a horizontal circular path around the inside of the bowl. Preferably, the drain has an annular collar or housing comprising a central waste line and an annular return. Aqueous medium driven by the pump passes into the annular collar or return. Water is forced through the return into the sink in a path that surrounds the drain and waste pipe. At the point of entry into the sink, the flow of aqueous medium contacts a stator portion of the annular collar or housing that forces the liquid to take a circular path horizontally in this bowl. The waste line is valved to hold the aqueous medium within the bowl return and pump mechanism when circulation is desired. The pump takes aqueous cleaning media from the waste line upstream from the valve. When the pump is activated, aqueous medium is pumped through the stator into the sink forming a continuous horizontal circular or swirling motion that softens and aids in soil removal and also can cause a tumbling or agitation of the dishware and tableware in the sink.

Further, the apparatus can also contain a heater which can increase the temperature of the aqueous medium to improve action on the soil. Further, the sink of the invention can have a chemical dispenser installed on the sink to direct cleaning chemicals into the sink or into the lines to or from the pump. For the purposes of this application, the term "return" relates to a device that acts as a point of release of the water or aqueous medium while at the drain portion of the sink bottom.

BRIEF DISCUSSION OF THE DRAWINGS

FIGS. 1 and 2 are cross-sectional drawings illustrative of the operation of the invention. FIG. 1 shows a sink with a drain and drain installed central waste line having water drawn from the waste line into the pump and then to the annular cyclonic return installed in the drain. The pump derives water from the central waste line and returns it through the annular return causing the preferred horizontal circular motion. FIG. 2 shows an open waste line permitting any liquid contents of the apparatus to drain to municipal sewage treatment.

FIG. 3 is a view of the sink of the invention having a screen installed over the drain preventing entry of large waste objects into the waste line. Such objects could block the proper movement of water through the drain into the pump and return into the sink. Further, the pump contains cutting blades that rapidly and substantially comminute any particulate matter that passed from the drain into the pump. The particle size of the waste matter can be reduced substantially in this operation.

FIG. 4 is an isometric view of an installation of a preferred apparatus of the invention. The figure shows the drain installed in the sink and the waste line. Water from the waste line is drawn into the pump and is directed to the return for cyclonic horizontal agitation.

Figure 1:
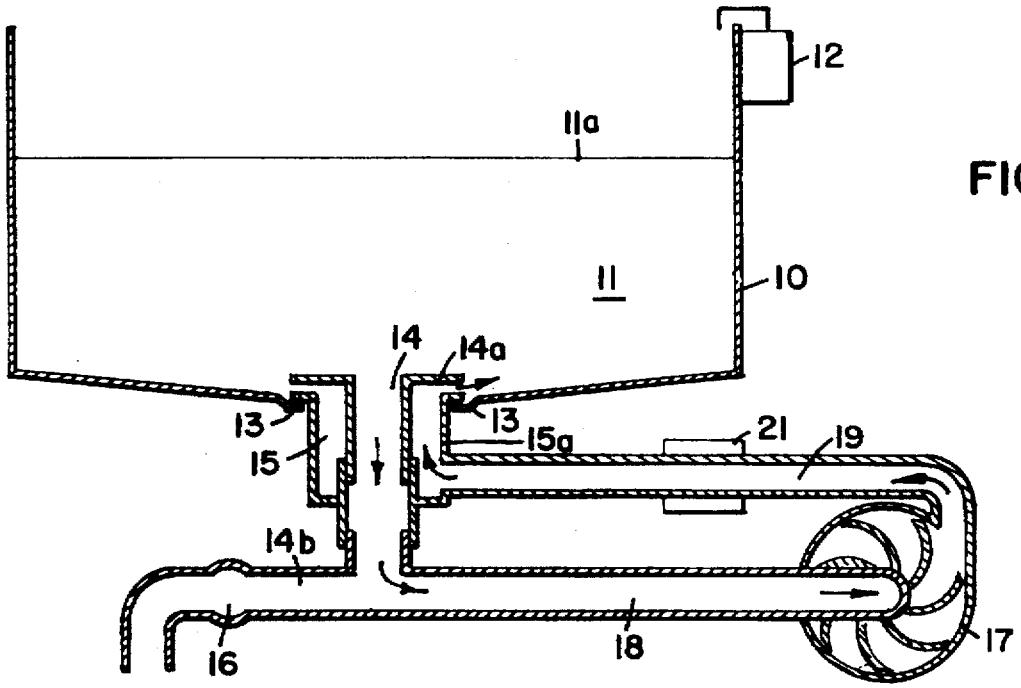

The figures further show an in-line heater to heat the aqueous liquid, a stator, veins or blades that can redirect the flow of the aqueous medium into a circular pattern. Lastly, the drawings show an offset drain that can be common in certain installations.

DETAILED DISCUSSION OF THE INVENTION

The sink of the invention can have one, two, three or more bowls that can contain a volume of aqueous cleaning medium. Such bowls can have a capacity of up to 200 liters or more depending on the installation location. The bowls can have a cubic shape, can be rectangular, can be oval, can be cylindrical or any other shape that can be manufactured in the form of a sink. The sink can be manufactured from a variety of materials including stainless steel, composite materials made from thermoplastic and fiber reinforcement, ceramic materials, porcelain, porcelain-coated iron or steel sinks or other common materials useful in sink construction.

In the bowl of each sink of the invention is a drain. The term "drain" is intended to indicate simply an aperture that typically takes the form of a circular opening that can permit the aqueous contents of the sink to be directed to a waste line. Such drains have conventional diameters (commonly 3.5") adapted to fit standard plumbing hardware leading to the waste lines. The invention involves in one embodiment, altering the plumbing hardware leading to the waste line such that aqueous cleaning means can be withdrawn from a waste line using a pump. The aqueous medium drawn by the pump is then directed through a line back into hardware installed in the drain such that the aqueous medium is directed through a return such that the flow is directed into the sink in a horizontal, circular or swirling pattern. Such sink hardware can be made from common plumbing materials including metallic plumbing apparatus, plastic drain material such as ABS (acrylonitrile-butadiene-styrene) butylene polymers, plastics or other metal or plastic materials approved for use in such drain locations.

The pump useful in the sink installations of the invention is a pump having a capacity of about 75 to 1000 gallons per minute having an energy output of 0.25 to 4 horsepower. Typically, the pumps are electrically driven but can be driven by a variety of systems. In the preferred mode of operating the apparatus of the invention, the waste line is valved such that when the pump is initiated, the valve is closed holding the aqueous medium within the system comprising sink or bowl pump, stator and appropriate lines. The aqueous medium is drawn from the waste line upstream of the valve into the pump and is then directed back into the base of the sink through the drain return or stator apparatus in a horizontal swirling motion. The aqueous cleaning medium in the sink can be heated at any place in the sink or in the apparatus, lines or pump. One preferred location of a heater is an in-line heater in the line conveying aqueous medium from the waste line to the pump or installed in the line from the pump returning water to the sink. Alternatively, the heater can be installed in the base of the bowl or in the bowl side. Further, the bowl can have a chemical dispenser installed such that cleaning compositions can be introduced into the aqueous medium in the bowl or through the lines during pump operation.

DETAILED DISCUSSION OF THE DRAWINGS

FIG. 1 is a cross-sectional representation of the apparatus of the invention. In FIG. 1 a sink bowl 10 contains a volume of water or an aqueous cleaning medium or solution 11 defined by the liquid surface 11*a*. Such an aqueous cleaning medium can be formed by introducing a volume of water into the bowl 10 augmented by chemicals delivered into the bowl by dispenser 12. The volume of water or aqueous cleaning medium 11 in the bowl is added to sufficient capacity to substantially cover or include any dishware, kitchenware, tableware or other object requiring cleaning in the bowl 10. In the base of the bowl is a drain 13 comprising a generally circular drain opening (commonly about 3.5 inches in diameter). Such a drain 13 is a standard size common in sinks and bowls used in food preparation, kitchen and warewashing operations. Installed in the drain 13 is an apparatus including a central waste line 14 and an annular return 15. In operation, the water or aqueous cleaning medium 11 enters the drain 14 and if valve 16 is closed, can flow only to pump 17 wherein the water or aqueous cleaning medium is directed to return 15. Return 15 is configured such that the flow of water or aqueous cleaning medium exiting return 15 forms a cyclonic horizontal agitation pattern causing water or aqueous cleaning medium to contact kitchenware, tableware or other soiled ware with the aqueous cleaning medium in a highly effective energetic tumbling motion. In FIG. 1, the waste line 14 is a central drain having an annular return housing 15*a*, surrounding the central waste line 14. The waste line/return apparatus is made from a cylindrical portion that is cooperatively attached in fluid communication with the waste line 14*b*, the liquid conduit 18 to the pump 17 and the liquid conduit 19 from the pump 17 to the return 15. The apparatus has an circular cylindrical/central portion 14*a* which partially defines the waste line and the horizontal cyclonic return path. When the pump 17 is energized, water is drawn from the waste line 14 through line 18 and to pump 17 wherein the water is then returned under pressure through line 19 into the return 15 to create a highly energetic cyclonic agitation and flow. An in-line heater 21 is installed to heat water flowing in line 19.

Figure 2:
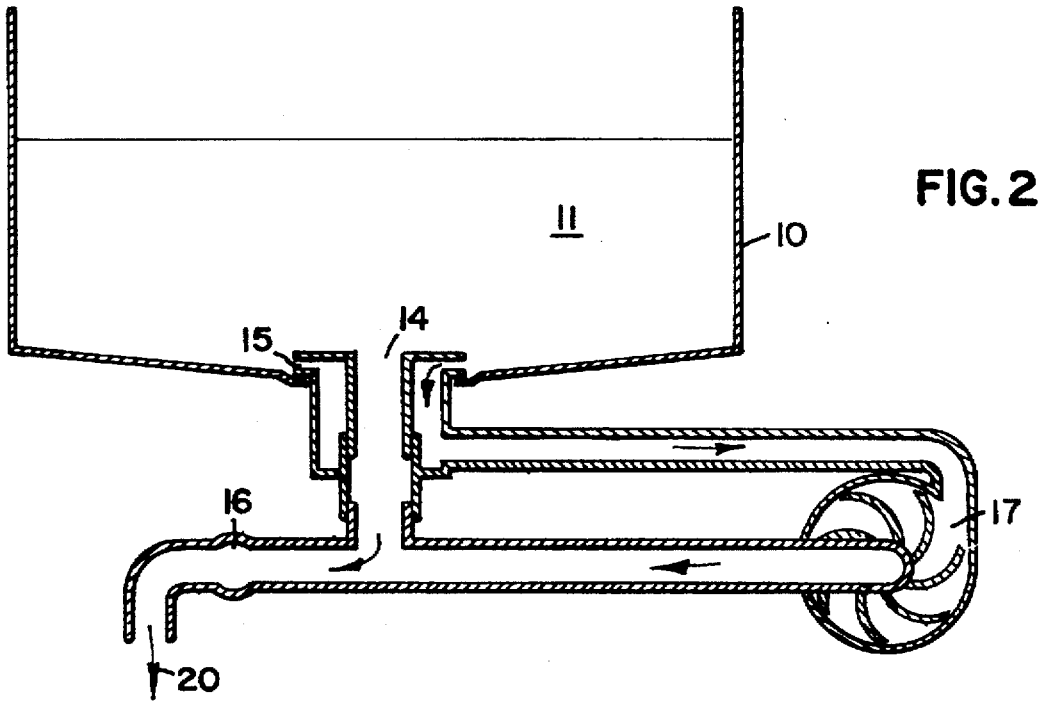

FIG. 2 is a cross-sectional diagram of the apparatus of the invention showing the operation of the apparatus when valve 16 is open and pump 17 is not in operation, permitting flow of water or aqueous cleaning medium from the bowl 10 through the waste line 14 into the municipal sewer service 20. Some proportion of water or aqueous cleaning medium 11 flows through return 15 through pump 17 ultimately passing valve 16 into the municipal sanitary sewer 20. In this mode of operation, the apparatus permits drainage of water or aqueous cleaning medium efficiently carrying with it, soil removed from the ware. In this mode of operation, the pump is not activated and is simply a portion of the drain line.

Figure 3:
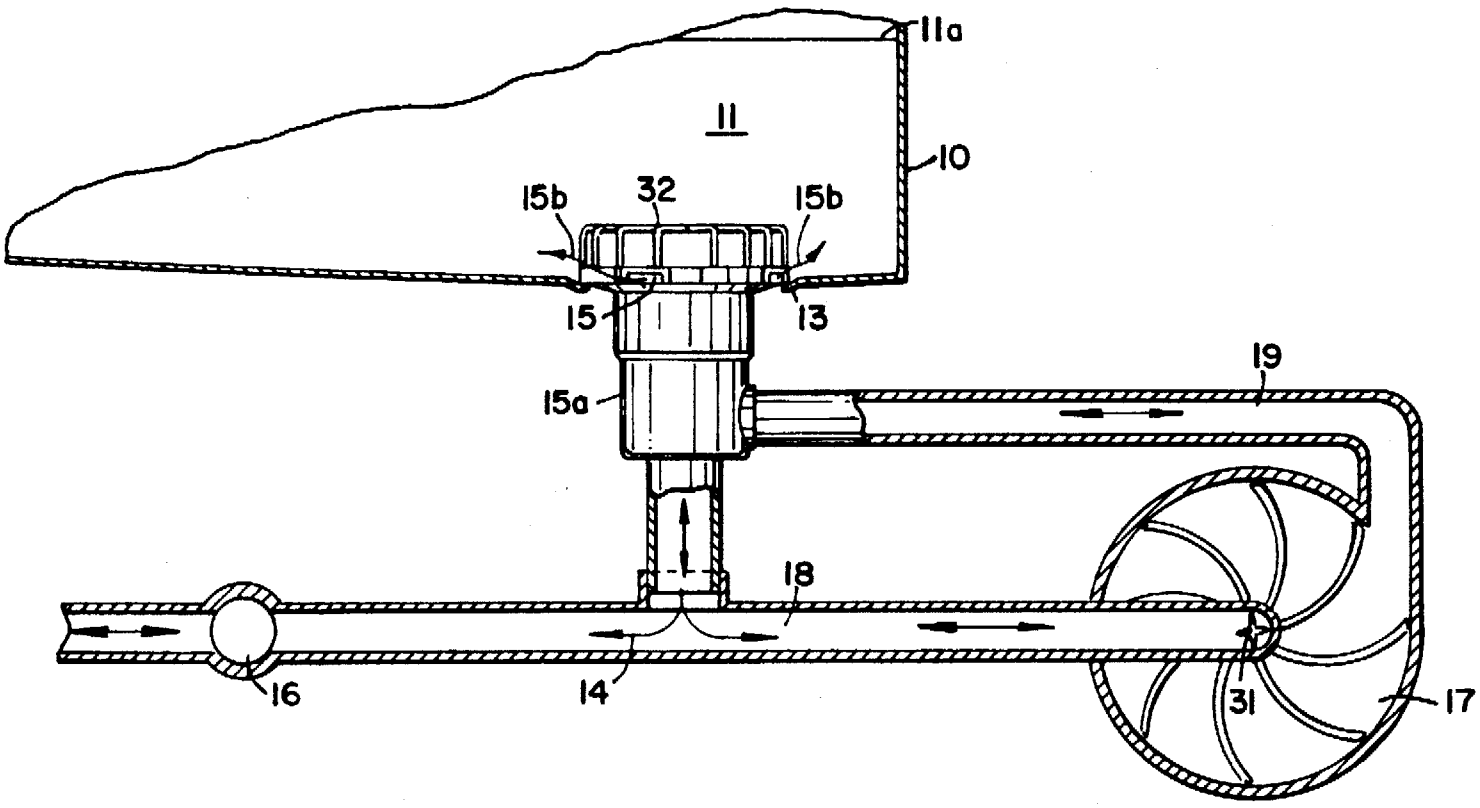

FIG. 3 is a partial cross-sectional representation of an embodiment of the apparatus of the invention similar to that shown in FIG. 1. In FIG. 3, drain 13 is shown in an offset position, offset from the center of bowl 10. In bowl 10 is shown a volume of water or aqueous cleaning medium 11 with liquid surface 11*a*. In drain 13, the apparatus, comprising a central waste line and an annular return, of the invention is shown installed in a noncross-sectional view. The apparatus of the invention includes the exterior shell or housing 15*a* of the return component. Water or aqueous cleaning medium passing through the annular return section of the apparatus within housing 15*a*, and exits the return portions 15 creating the cyclonic flow of water or aqueous cleaning medium in the bowl represented by the arrows 15*b*. These arrows 15*b* represent a cyclonic horizontal agitation of water or aqueous cleaning medium in the bowl 10. In the central portion of that housing 15*a* is a waste line 14 that can direct water or aqueous cleaning medium to the drain if valve 16 is open. If valve 16 is closed and pump 17 is energized, water or aqueous cleaning medium is drawn from the waste line 14 into the pump and is then redirected to return 15 causing the cyclonic motion represented by the arrows 15*b*. Water from pump 17 passing through line 19 is directed to the annular space inside the housing 15*a* that surrounds the waste line within the housing not shown. A screen 32 is shown covering the entry to the waste line (not shown). This screen prevents entry of particulate matter of a size greater than the screen openings. Preferred screen openings have a dimension of about 5 to 20 millimeters, preferably about 10 to 15 millimeters. In the unlikely instance large particulate matter enters drain line 14, such particulate encounters a cutting wheel 31 that rapidly comminutes or reduces the particle size of the particulate matter substantially preventing any plugging of the waste line pump lines or return. Depending on the nature of the ware contained within the aqueous cleaning medium in the sink, the cleaning medium can be contaminated with substantial amounts of a variety of different types of particulate soils.

Figure 4:
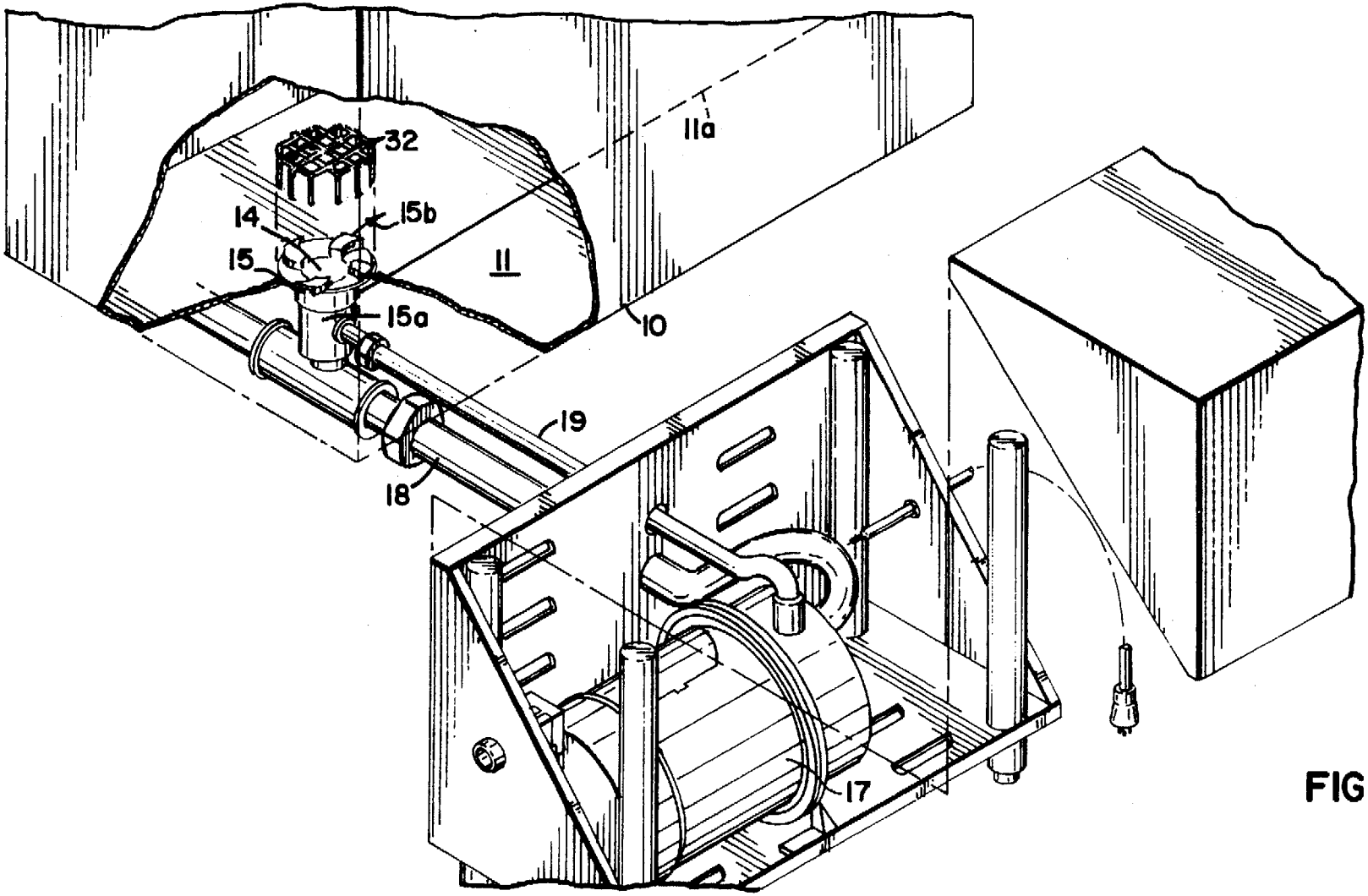

FIG. 4 is an isometric drawing of one embodiment of the apparatus of the invention. The apparatus is shown in two portions joined by a pump intake line 18 and a pump outlet line 19. These lines, 18 and 19 are connected to pump 17. Pump 17 draws water or aqueous cleaning solution 11 from sink or bowl 10. The level 11*a* of the water or aqueous cleaning solution 11 is contained within the sink or bowl 10. The water or aqueous cleaning solution 11 is drawn through waste line 14 into line 18 which directs the flow of water or aqueous cleaning solution to pump 17. The water or aqueous cleaning solution exits the pump under pressure through line 19 and is directed to the annular return housing 15*a*. The water flows through an annular passage surrounding intake 14 enclosed by housing 15*a* and exits the return through stator or nozzle 15 which create the cyclonic or circular horizontal turbulent flow pattern 15*b* in sink 10. Screen 32 can be fit over the inlet 14 above the outlets 15.

Figure 5:
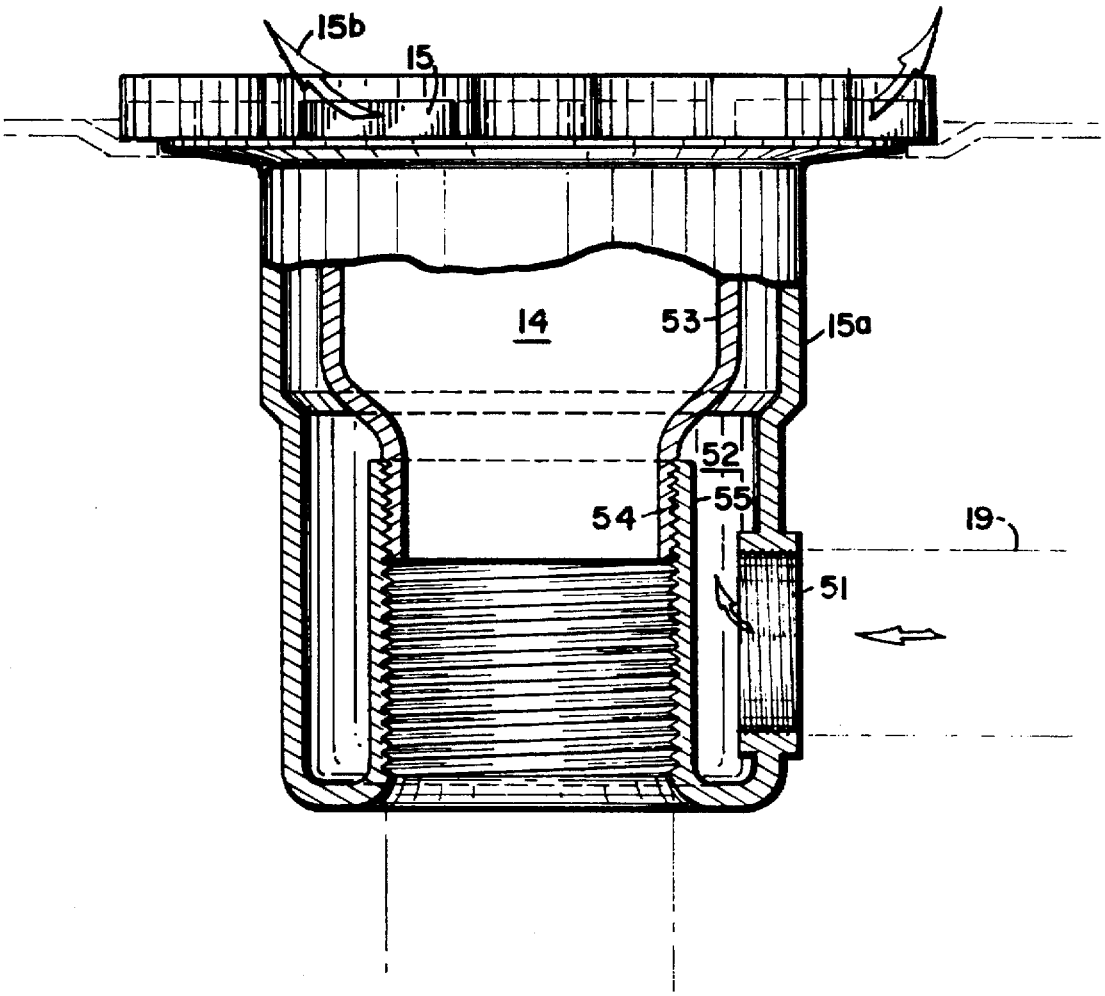
FIG. 5 is a partial cross-section of the combined waste line/annular cyclonic return apparatus of the invention installed in the drain. The figure shows the central waste line, the annular return and the flow members creating the cyclonic flow.

FIG. 5 is a partial cross-sectional representation of the cylindrical portion comprising the central waste line 14 for water or aqueous cleaning solution and the annular return space comprising a return for the water or aqueous cleaning solution under pressure. The cylindrical apparatus comprises a housing 15*a* having a threaded inlet portion 51 adapted to the inlet pipe 19 shown in phantom. When the pump is energized, water or other aqueous cleaning solution enters the annular space 52 surrounding the central waste line 14 for water or aqueous cleaning solution, passes through the annular space 52 and exits the outlets 15 forming the horizontal cyclonic pattern 15*b*. This apparatus is assembled by inserting housing 53 into housing 15*a*. Housing 53 cooperatively connects to housing 15*a* using the mated threaded portions 54 and 55. Housing 53 is manufactured with integral stator outlets 15 for the water or aqueous cleaning solution.

Figure 6:
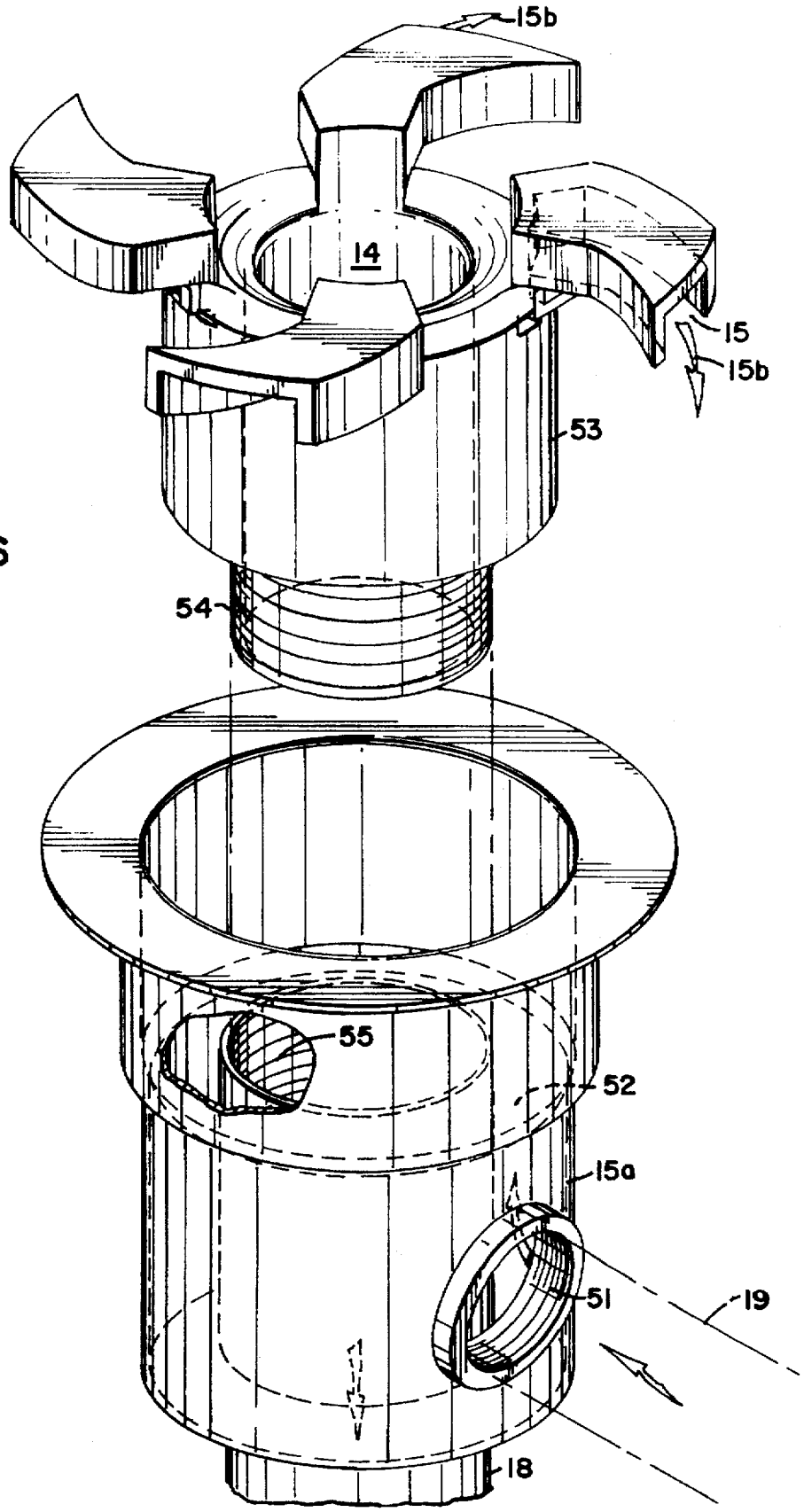
FIG. 6 is an exploded revealed view of the assembly of the apparatus of FIG. 5.

FIG. 6 is an exploded isometric view of the apparatus of FIG. 5. The housing 15*a* contains threaded inlet 51 comprising an inlet portion for line 19 shown in phantom. Water or aqueous cleaning medium flows through the threaded opening into the annular space 52 from where it flows upwardly into housing 53. The water or aqueous cleaning solution is in liquid communication with the stator outlets 15. Threaded portion 54 can be inserted and turned down into threaded portion 55 for assembly of the unit. The water or aqueous liquid intake 14 permits entry of water or aqueous cleaning medium into the apparatus which flows through the center of the apparatus into either the drain or into line 18 leading to the pump 17 not shown.

DETAILED DESCRIPTION OF THE AQUEOUS MEDIUM AND CLEANING CHEMICALS

Surfactants

Various types of surfactants can be used in the compositions of this invention. Useful surfactants include anionic, nonionic, ampholytic, zwitterionic and cationic surfactants or mixtures of such materials. Compositions typically contain from about 5% to about 30% anionic surfactants, mixtures of anionic and nonionic surfactants or cationic surfactants. Compositions for use in warewashing typically contain from about 2% to about 6% by weight of a relatively low sudsing nonionic surfactant or mixtures thereof and, optionally, suds control agents. Particularly suitable low sudsing nonionic surfactants are the alkoxylation products of compounds containing at least one reactive hydrogen wherein, preferably, at least about 20% by weight of the alkylene oxide by weight is propylene oxide. Examples are products of the BASF-Wyandotte Corporation designated Pluronic®, Tetronic®, Pluradot® and block polymeric variations in which propoxylation follows ethoxylation. Preferred suds control agents include mono- and distearyl acid phosphates.

The various classes of surfactants useful in the cleaning compositions herein are exemplified as follows:

(A) Anionic soap and non-soap surfactants

This class of surfactants includes alkali metal monocarboxylates (soaps) such as the sodium, potassium, ammonium and alkylolammonium salts of higher fatty acids containing from about 8 to about 24 carbon atoms and preferably from about 12 to about 18 carbon atoms. Suitable fatty acids can be obtained from natural sources such as, for instance, from plant or animal esters (e.g., palm oil, coconut oil, babassu oil, soybean oil, caster oil, tallow, whale and fish oils, grease, lard, and mixtures thereof). The fatty acids also can be synthetically prepared (e.g., by the oxidation of petroleum, or by hydrogenation of carbon monoxide by the Fischer-Tropsch process). Resin acids are suitable such as rosin and those resin acids in tall oil. Naphthenic acids are also suitable. Sodium and potassium soaps can be made by direct saponification of the fats and oils or by the neutralization of the free fatty acids which are prepared in a separate manufacturing process. Particularly useful are the sodium and potassium salts of the mixtures of fatty acids derived from coconut oil and tallow, i.e., sodium or potassium tallow and coconut soap. Soaps and fatty acids also act as detergency builders in detergent compositions because they remove multivalent ions by precipitation.

Anionic surfactants also include water soluble salts, particularly the alkali metal and ethanolamine salts of organic sulfonation or sulfation reaction products having in their molecular structure an alkyl radical containing from about 8 to about 22 carbon atoms and a sulfonic acid or sulfuric acid ester radical. (Included in the term alkyl is the alkyl portion of alkylaryl radicals.) Examples of this group of non-soap anionic surfactants are the alkyl sulfates, especially those obtained by sulfating the higher alcohols ($C_8$–$C_{18}$ carbon atoms); alkyl benzene sulfonates, in which the alkyl group contains from about 9 to about 15 carbon atoms, in straight chain or branched chain configuration, sodium alkyl glyceryl ether sulfonates; fatty acid monoglyceride sulfonates and sulfates; sulfuric acid esters of the reaction product of one mole of a $C_{12-18}$ alcohol and about 1 to 6 moles of ethylene oxide and salts of alkyl phenol ethylene oxide ether sulfate with about 1 to about 10 units of ethylene oxide per molecule and in which the alkyl radicals contain about 8 to about 12 carbon atoms.

Additional examples of non-soap anionic surfactants are the reaction products of fatty acids esterified with isethionic acid and neutralized with sodium hydroxide where, for example, the fatty acids are derived from coconut oil and sodium or potassium salts of fatty acid amide of methyl lauride in which the fatty acids, for example are derived from coconut oil.

Still other anionic surfactants include the class designated as succinamates. This class includes such surface active agents as disodium N-octadecylsulfosuccinamate; tetrasodium N-(1.2-dicarboxyethyl)-N-octadecylsulfosuccinamate; the diamyl ester of sodium sulfosuccinic acid; the dihexyl ester of sodium sulfosuccinic acid and the dioctyl ester of sodium sulfosuccinic acid.

Anionic phosphate surfactants are also useful in the detergent or laundry additive compositions of the present invention. These are surface active materials having substantial detergent capability in which the anionic solubilizing group connecting hydrophobic moieties is an oxy acid of phosphorus. The more common solubilizing groups are —$SO_4H$, —$SO_3H$, and —$CO_2H$. Alkyl phosphate esters such as $(R—O)_2PO_2H$ and $ROPO_3H_2$ in which R represents an alkyl chain containing from about 8 to about 20 carbon atoms are useful.

These esters can be modified by including in the molecule from one to about 40 alkylene oxide units, e.g., ethylene oxide units.

Particularly useful anionic surfactants for incorporation into the compositions herein are alkyl ether sulfates. The alkyl ether sulfates are condensation products of ethylene oxide and monohydric alcohols having about 10 to about 20 carbon atoms. Preferably, R has 12 to 18 carbon atoms. The alcohols can be derived from fats, e.g., coconut oil or tallow, or can be synthetic. Such alcohol's are reacted with 0.5 to 30, and especially 1 to 6, molar proportions of ethylene oxide and the resulting mixture of molecular species, having, for example, an average of 3 to 6 moles of ethylene oxide per mole of alcohol, is sulfated and neutralized.

Other suitable anionic surfactants are olefin and paraffin sulfonates having from about 12 to about 24 carbon atoms.

(B) Nonionic surfactants

Alkoxylated nonionic surfactants may be broadly defined as compounds produced by the condensation of alkylene oxide groups (hydrophilic in nature) with an organic hydrophobic compound, which may be aliphatic or alkyl aromatic in nature. The length of the hydrophilic or polyoxyalkylene radical which is condensed with any particular hydrophobic group can be readily adjusted to yield a water soluble compound having the desired degree of balance between hydrophilic and hydrophobic elements.

Alkoxylated nonionic surfactants include:

(1) The condensation product of aliphatic alcohols having from 8 to 22 carbon atoms, in either straight chain or branched chain configuration, with from about 5 to about 20 moles of ethylene oxide per mole of alcohol.

(2) The polyethylene oxide condensates of alkyl phenols, e.g., the condensation products of alkyl phenols having an alkyl group containing from about 6 to 12 carbon atoms in either a straight chain or branched chain configuration, with ethylene oxide, the ethylene oxide being present in amounts of from about 5 to about 25 moles of ethylene oxide per mole of alkyl phenol. The alkyl substituent in such compounds may be derived from polymerized propylene, diisobutylene, octene, or nonene, for example.

(3) Materials derived from the condensation of ethylene oxide with a product resulting from the reaction of propylene oxide and a compound with reactive hydrogen such as glycols and amines such as, for example, compounds containing from about 40% to about 80% polyoxyethylene by weight resulting from the reaction of ethylene oxide with a hydrophobic base constituted of the reaction product of ethylene diamine and propylene oxide.

Non-polar nonionic surfactants include the amine oxides (which are nonionic or cationic, depending on pH) and corresponding phosphine oxides. Useful amine oxide surfactants include those having the formula $R^1R^2R^3N\rightarrow O$ wherein $R^1$ is an alkyl group containing from about 10 to about 28 carbon atoms, from 0 to about 2 hydroxy groups and from 0 to about 5 ether linkages, there being at least one moiety of $R^1$ which is an alkyl group containing from about 10 to about 18 carbon atoms and $R^2$ and $R^3$ are selected from the group consisting of alkyl radicals and hydroxyalkyl radicals containing from 1 to about 3 carbon atoms.

Specific examples of amine oxide surfactants include: dimethyldodecylamine oxide, dimethyltetradecylamine oxide, ethylmethyltetradecylamine oxide, cetyldimethylamine oxide, diethyltetradecylamine oxide, dipropyldodecylamine oxide, bis-(2-hydroxyethyl)-dodecylamine oxide, bis-(2-hydroxypropyl)methyltetradecylamine oxide, dimethyl-(2-hydroxydodecyl)amine oxide, and the corresponding decyl, hexadecyl and octadecyl homologs of the above compounds.

Additional operable nonionic surfactants include alkyl glucosides and alkylamides of the formula:

$$R_1—\overset{\overset{\displaystyle O}{\|}}{C}—NHR_2$$

wherein $R_1$ is $C_{10}$–$C_{18}$ alkyl and $R_2$ is —H, —$CH_2$ or —$C_2H_5$.

(D) Cationic Surfactants

Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Suitable anions are halides, methyl sulfate and hydroxide. Tertiary amines can have characteristics similar to cationic surfactants at washing solutions pH values less than about 8.5.

A more complete disclosure of cationic surfactants can be found in U.S. Pat. No. 4,228,044, issued Oct. 14, 1980, to Cambre, incorporated herein by reference.

When cationic surfactants are used in combination with anionic surfactants and certain detergency builders including polycarboxylates, compatibility must be considered. A type of cationic surfactant generally compatible with anionic surfactants and polycarboxylates is a $C_{8-18}$ alkyl tri $C_{1-3}$ alkyl ammonium chloride or methyl sulfate.

More complete disclosures of surfactants suitable for incorporation in the compositions of the present invention are in U.S. Pat. Nos. 4,056,481, Tate (Nov. 1, 1977); 4,049,586, Collier (Sep. 20, 1977); 4,040,988, Vincent et al. (Aug. 9, 1977); 4m035,257, Cherney (Jul. 12, 1977); 4,033,718, Holcolm et al. (Jul. 5, 1977); 4,019,999, Ohren et al. (Apr. 26, 1977); 4,019,988, Vincent et al. (Apr. 26, 1977); and 3,985,669, Krummel et al. (Oct. 12, 1976); all of said patents being incorporated herein by reference.

Polyphosphonate detergency builders comprise a large range of organic compounds having two or more:

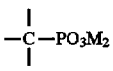

groups, wherein M is hydrogen or a salt-forming radical. Suitable phosphonates include ethane-1-hydroxy-1,1-diphosphonates, ethanehydroxy-1,1,2-triphosphonates and their oligomeric ester chain condensates. Suitable polyphosphonates for use in the compositions of the invention also include nitrogen-containing polyphosphonates such as ethylenediaminetetrakis (methylenephosphonic) acid and diethylenetriaminepentakis (methylenephosphonic) acid and alkali metal, ammonium and substituted ammonium salts thereof. In common with other phosphorus-containing components, the incorporation of phosphonates may be restricted or prohibited by government regulation.

As discussed hereinbefore $C_{8-24}$ alkyl monocarboxylic acid and soluble salts thereof have a detergent builder function in addition to surfactant characteristics. $C_8$–$C_{24}$ alkyl, alkenyl, alkoxy and thio-substituted alkyl dicarboxylic acid compounds, such as 4-pentadecene-1,2-dicarboxylic acid, salts thereof and mixtures thereof, are also useful optional detergency builders.

Inorganic detergency builders useful in the detergent and laundry additive compositions of this invention at total combined levels of from 0% to about 75% by weight, include alkali metal phosphates, sodium aluminosilicates, alkali metal silicates and alkali metal carbonates.

Phosphate detergency builders include alkali metal orthophosphates which remove multivalent metal cations from laundry solutions by precipitation and the polyphosphates such as pyrophosphates, tripolyphosphates and water soluble metaphosphates that sequester multivalent metal cations in the form of soluble complex salts or insoluble precipitating complexes. Sodium pyrophosphate and sodium tripolyphosphate are particularly suitable in granular detergent and laundry additive compositions to the extent that governmental regulations do not restrict or prohibit the use of phosphorus-containing compounds in such compositions. Granular detergent and laundry additive composition embodiments of the invention particularly adapted for use in areas where the incorporation of phosphorus-containing compounds is restricted contains low total phosphorus and, preferably, essentially no phosphorus.

Other optional builder material include aluminosilicate ion exchange materials, e.g. zeolites. Crystalline aluminosilicate ion exchange materials useful in the practice of this invention have the formula $Na_z[(AlO_2)_z(SiO_2)_y]H_2O$ wherein z an y are at least about 6, the molar ratio of z to y is from about 1.0 to about 0.5 and x if from about 10 to about 264. In a preferred embodiment the aluminosilicate ion exchange material has the formula $Na_{12}[(AlO_1)_{12}(SiO_2)_{12}]_xH_2O$ wherein x is from about 20 to about 30, especially about 27.

Other optional builders include alkali metal silicates. Suitable alkali metal silicates have a mole ratio of $SiO_2$ alkali metal oxide in the range of from about 1:1 to about 4:1. The alkali metal silicate suitable herein include commercial preparations of the combination of silicon dioxide and alkali metal oxide or carbonate fused together in varying proportions according to, for example, the following reaction:

$$mSiO_2 + Na_2CO_3 \xrightarrow{(2600^\circ F.)} mSiO_2{:}Na_2O + CO_2$$

The value of m, designating the molar ratio of $SiO_2$:$Na_2O$, ranges from about 0.5 to about 4 depending on the proposed use of the sodium silicate. The term "alkali metal silicate" as used herein refers to silicate solids with any ratio of $SiO_2$ to alkali metal oxide. Silicate solids normally possess a high alkalinity content; in addition water of hydration is frequently present as, for example, in metasilicates which can exist having 5, 6, or 9 molecules of water. Sodium silicate solids with a $SiO_2$:$Na_2O$ mole ratio of from about 1.5 to about 3.5, are preferred in granular laundry detergent compositions. Silicate solids are frequently added to granular detergent or laundry additive compositions as corrosion ihibitors to provide protection to the metal parts of the washing machine in which the detergent or laundry additive composition is utilized. Silicates have also been used to provide a degree of crispness and pourability to detergent or laundry additive granules which is very desirable to avoid lumping and caking. Alkali metal carbonates are useful in the compositions of the invention as a source of washing solution alkalinity and because of the ability of the carbonate ion to remove calcium and magnesium ions from washing solutions by precipitation.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A domestic or institutional sink adapted to cleaning with an agitated aqueous cleaning medium, the sink comprising:

(a) at least one bowl having a liquid capacity of up to about 200 liters of aqueous cleaner;

(b) a drain in the bowl;

(c) a waste line leading from the drain; and (d) a pump in liquid communication with the waste line such that the aqueous cleaner is removed by the action of the pump, and is returned to the bowl through a stator formed as an annular housing of the drain and providing a stream that can agitate the aqueous cleaner in a substantially horizontal cyclonic pattern.

2. The sink of claim 1 wherein the liquid capacity of the bowl is about 5 to 100 liters.

3. The sink of claim 1 wherein the aqueous cleaner comprises a major proportion of an aqueous medium and a minor proportion of a cleaning material selected from the group consisting of a surfactant, a solvent, an acid, a base, a bleach or compatible mixtures thereof.

4. The sink of claim 3 wherein the surfactant is a nonionic surfactant.

5. The sink of claim 3 wherein the surfactant is an anionic surfactant.

6. The sink of claim 1 wherein the pump has a capacity of 70 to 1250 liters per minute.

7. A domestic or institutional sink, adapted to cleaning with an agitated aqueous cleaning medium, the sink comprising:

(a) at least one bowl having a liquid capacity of up to 200 liters of an aqueous cleaner;

(b) a drain installed in the bowl, the drain leading to a waste line having a valve, the drain also having an annular return stator for the aqueous medium; and (c) a pump in intake liquid communication with the waste line upstream of the valve, and in liquid outlet communication with the annular return stator for the aqueous medium;

wherein the pump can draw aqueous cleaning medium from the waste line and return the medium to the sink through the annular return stator, forming an agitated aqueous cleaning medium in the bowl.

8. The sink of claim 7 wherein the annular return stator surrounds the waste line and forms a horizontal cyclonic motion of the aqueous cleaner within the bowl.

9. The sink of claim 7 wherein the waste line has an in-line heater.

10. The sink of claim 7 wherein the pump is a centrifugal pump.

11. The sink of claim 10 wherein the centrifugal pump has a capacity of about 70 to 1250 liters per minute.

12. The sink of claim 7 wherein the liquid capacity of the bowl is about 10 to 100 liters.

13. The sink of claim 7 wherein the aqueous cleaner comprises a major portion of an aqueous medium and a minor proportion of a cleaning material selected from the group consisting of a surfactant, a solvent, an acid, a base, a bleach, or compatible mixtures thereof.

14. The sink of claim 13 wherein the surfactant is a nonionic surfactant.

15. The sink of claim 13 wherein the surfactant is an anionic surfactant.

16. The sink of claim 7 additionally comprising a chemical dispenser that is conformed to introduce cleaning chemicals into the aqueous medium.

17. The sink of claim 7 wherein an in-line heater is installed in liquid communication with the pump intake or the pump outlet.

18. The sink of claim 7 wherein the drain has a diameter of 3.5 inches.

19. The sink of claim 7 wherein the drain is offset from the center of the bowl.

* * * * *